US005163492A

United States Patent [19]

Remington et al.

[11] Patent Number: 5,163,492

[45] Date of Patent: Nov. 17, 1992

[54] VERTICAL BLIND VANE TILT CONTROL LOCK

[76] Inventors: Todd D. Remington, 6712 Farragut; Michael J. Meehan, 6821 Forrest St., both of Hollywood, Fla. 33024

[21] Appl. No.: 717,507

[22] Filed: Jun. 19, 1991

[51] Int. Cl.[5] ..... E06B 9/26

[52] U.S. Cl. ..... 160/176.1; 160/178.2; 160/321

[58] Field of Search ..... 160/178.2, 178.1, 321, 160/307, 900, 193, 176.1; 24/116 A; 211/70.6

[56] References Cited

U.S. PATENT DOCUMENTS

| | | | |
|---|---|---|---|
| 1,721,338 | 7/1929 | Gagnon | 24/116 A |
| 2,291,381 | 7/1942 | Drake | 211/70.6 X |
| 2,562,259 | 7/1951 | Burns | 160/321 X |
| 2,754,008 | 7/1956 | Culver | 211/70.6 X |
| 3,187,902 | 6/1965 | Nelson | 211/70.6 |

FOREIGN PATENT DOCUMENTS

| | | | |
|---|---|---|---|
| 725059 | 2/1932 | France | 160/321 |

*Primary Examiner*—Blair M. Johnson

*Attorney, Agent, or Firm*—Malin, Haley, McHale, DiMaggio & Crosby

[57] ABSTRACT

A vertical blind vane tilt control lock for manually locking in a rigid position the vane tilt chain actuating mechanism for vertical blinds to prevent undesired movement of the vertical blind vanes by wind or air passing through the vanes. The control chain locking device is rigidly fastened to a wall surface near the chain actuator so that it can be manually engaged or disengaged as desired. The chain control lock includes one or two locking slots so that both sides of the vane tilt actuating chain are held taut from the vertical blind actuating pulley to prevent movement of the vanes.

3 Claims, 1 Drawing Sheet

VERTICAL BLIND VANE TILT CONTROL LOCK

BACKGROUND OF THE INVENTION

1. Field of the Invention

This invention relates to a control lock for use with a vertical blind vane tilt control actuator to prevent unwanted rotational movement of the vertical blind vanes, and specifically to a wall-mounted chain lock that secures the vane tilt control chain used to rotate the vertical blind vanes in unison, either open or closed or to a position therebetween to prevent unwanted movement for closing of the blind vanes which may be caused by wind or air flow.

2. Description of the Prior Art

Vertical blinds for covering windows, sliding glass doors, and the like to reduce solar radiation and increase privacy are well known in the prior art. Typically, vertical blinds are elongated usually rectangular, narrow fiber or plastic slats or vanes that are suspended from pantographs or clips attached to a horizontally disposed tilt rod control mechanism that is used to rotate the vanes from a closed position rotationally to approximately 90° to an open position in unison. A ball chain formed in a closed loop is most often used as the manual vane control actuator. The vane control chain is attached to the tilt rod actuator mechanism usually a pulley and the chain is normally suspended in a partial loop on one side of the vertical blinds for easy manual access.

One of the problems with vertical blinds is that they are often used to cover screened windows or sliding doors which permits wind or indoor air to flow therethrough for ventilation purposes. The thin vertical vanes can be directed by wind or air blowing through screened openings causing all of the vanes to move rotationally often either moving the blinds and vanes from their present position to an undesired position either open or closed. The purpose of the present invention is to fasten the individual vanes in a desired position (open, closed or in between) to prevent movement which may be caused by wind or air blowing through the vanes from their intended position.

U.S. Pat. No. 4,425,956 issued to Terlecke, Jan. 7, 1984, shows a vertical panel actuating mechanism, which includes a chain locking device for opening and closing the entire blind mechanism. There is no tilt lock mechanism described in Terlecke and therefore no vane locking mechanism. Therefore the locking mechanism shown in Terlecke does not prevent the wind or air stream from blowing or rotating the vanes from one position to a different position. U.S. Pat. No. 3,921,694 issued to Galex, Nov. 25, 1975 shows vertical blinds with a locking mechanism of some complexity. It is again used for opening the entire panel of blinds and is not related to a vane tilt mechanism. U.S. Pat. No. 4,425,955 issued to Kaucic, Jan. 17, 1984, also shows a chain locking mechanism used internally for vertical blinds relating to opening and closing the entire panels but not through the tilt lock mechanism.

None of the references in the prior art show a vane tilt control locking mechanism or vane tilt chain locking mechanism that is capable of establishing vanes in a fixed position to prevent rotation which may be caused by an air stream striking the vertical vanes. The present invention can be quickly mounted on a wall or vertical surface near the vane tilt control chain which hangs by gravity along one side of the vertical blinds. Thus, the invention can be used with existing vertical blinds and is simple to install with a threaded connector and screwdriver. Another important feature is that once, mounted, the invention is very easy to manually engage or disengage the vane tilt control chain when desired.

SUMMARY OF THE INVENTION

A vertical blind vane tilt control lock for locking the control chain used for the vane tilt control mechanism of a vertical blind comprising a unitarily formed rigid body having a first portion that can engage and hold parallel segments of the vane tilt control chain in locking engagement while the chain is disposed vertically, and the rigid body having a second portion that permits the entire body to be attached to a vertical support surface such as the wall adjacent either side of the vertical blinds. A threaded fastener or nail can be disposed through an aperture in the second portion of the body to permit the apparatus in accordance with the invention to be mounted on a vertical support or wall surface.

The first portion of the chain control body that engages the ball chain used to control the vane tilt mechanism in one embodiment includes a substantially flat panel projecting from the wall surface at a 90° angle, the flat panel having two parallel slots with each slot being sized to receive the connector wire of the vane tilt control chain between two adjacent chain balls such that each slot is narrower in width than the diameter of the chain balls. This relationship in size between the chain ball diameter and the slot width and panel thickness insures that when a chain connector wire connecting to adjacent chain balls is inserted in each slot, the chain can be made taut from above and locked in position to prevent vertical movement. Two slots are necessary (preferably in a side by side relationship) to make the chain taut from the vane tilt pinion gear or control pulley on both segments of the control chain extending downward from the tilt vane control mechanism, thus preventing any movement of the control vane mechanism in either direction, firmly fixing each and all vertical vanes in their existing position.

In one embodiment, the rigid body of the invention is formed in an L-shaped body of two essentially flat panels, one of which contains the two parallel slots necessary to engage the chain. The other panel at a 90° angle to the first panel includes a centrally located hole that receives the screw or nail to attach the device to a wall. Other fastening devices may be utilized. The upper panel in addition includes a pair of upwardly oriented end tip flanges which prevent the chain once engaged from moving forward outwardly from the slot so that it is locked in the slot at all times. By proper manual manipulation for example, the lower ball when unlocking the chain from the slot slides to the forward position at the open end of the slot and then is raised vertically allowing both balls to be raised vertically.

The actuation and operation of the present invention is to lock the chain in place on both chain segments which goes through the vane tilt actuator or control mechanism. Typically the pinion gear and tilt rod is engaged into the mechanism along the top of the vertical track containing pantograph or clips which connect each vertical vane to provide rotational movement of all the vanes in unison to allow the vertical blinds to be opened (90°) or closed (180°). A different mechanism is used to slide all of the vanes apart along the track horizontally to open and close the entire panel which is not concerned with this invention.

Because the chain freely hangs from the control mechanism, operation of pulling the chain in either direction effects the rotation or tilting of all of the vanes in unison. The locking of both sides of the chain in place from the pinion gear by fastening onto the invention therefore insures that the vertical vanes cannot be rotated by wind or air blowing through the vertical panels keeping them stabilized while in a tilted position.

The body of the invention can be made from a molded plastic or other suitable material that has sufficient strength to pull the chain taught and maintain its support against the wall surface or the like. Although the body as shown is essentially an "L" shaped member, it is clear the body could be formed in other configurations provided there are sufficient engaging slots to make the chain tightly drawn on both sides of the vane tilt control pinion gear. In operation obviously the apparatus in accordance with the present invention is affixed to a wall surface in an area near the hanging actuating vane tilt control chain so that it can be easily connected to the chain and at a position from the floor that an average person could really grasp the chain and engage the locking mechanism of the apparatus. During installation the upper ball to be connected to the locking mechanism in accordance with the invention is placed behind the upward projecting flanges at the slot end and the lower ball connected by a connecting wire to the upper ball is then manipulated around to the bottom face of the panel and the two balls and wire mechanism slit inwardly on the slot where the chain is then taut and fixed in position.

It is an object of this invention to provide a tilt vane control chain locking device for vertical blinds.

It is another object of this invention to provide an improved chain actuator locking mechanism for controlling and locking the tilt of the vanes for vertical blinds so that the vanes can be stabilized and locked in a predetermined position preventing accidental movement or rotation from that position while the lock is engaged.

And yet still another object of this invention is to provide an improved vertical blind vane tilt control lock to prevent movement of vertical blind vanes accidentally by wind or air.

And yet still another object of this invention is to provide an apparatus for locking vertical blind vanes that is non-complex in construction, easy to install and easy to operate.

In accordance with these and other objects which will be apparent hereinafter, the instant invention will now be described with particular reference to the accompanying drawings.

PREFERRED EMBODIMENT OF THE INVENTION

Figure 1:
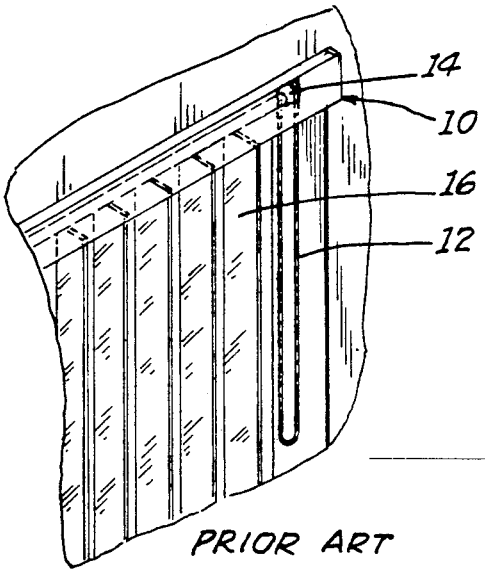
FIG. 1 is a partially cut away perspective view of conventional vertical blinds and represents the prior art.

Referring now to the drawings and in particular FIG. 1, a conventional vertical blind assembly is shown. Typically the vertical blind includes a tilt vane control chain 12 shaped in a loop which is the actuator or control chain connected to a pinion gear 14 which is attached to the tilt rod control mechanism mounted horizontally along the top of the vertical blinds. The vane tilt control mechanism is attached to pantographs (not shown) which hold each vane 16 vertically against gravity. Typically the vanes 16 may be plastic, metal or cloth and suspend vertically from the actuating mechanism 14A that causes upon rotation of the gear pinion 14 each of the vanes in place to rotate from 90° in either direction so that the blinds are either open or closed.

Figure 2:
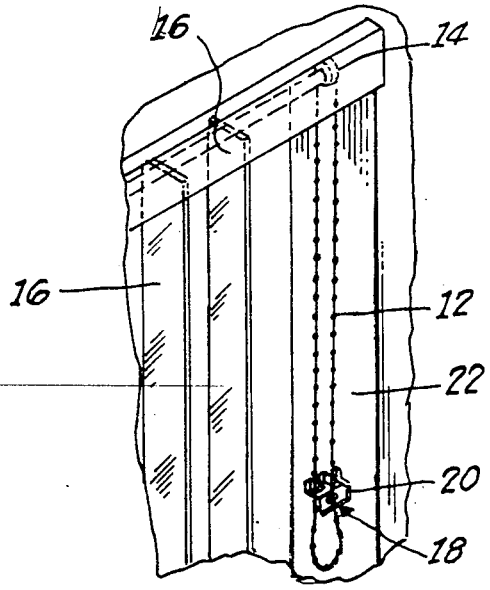
FIG. 2 is a partially cut away perspective view of conventional vertical blinds with the present invention utilized therewith.

The present invention is shown in FIG. 2 as a control chain locking apparatus 18 mounted by a threaded fastener 20 to the rigid vertical wall adjacent to blinds 22. As shown in FIG. 2 the tilt vane control chain is received through slots in the invention 18 as shown firmly fastened to wall 22 by fastener 20. Note in this locked position that the ball chain 12 is taut from pinion gear or pulley 14 on both sides down to the invention 18. In this taut condition, pulley or pinion gear 14 cannot rotate and thus the vanes themselves 16 are firmly locked in place and cannot move.

Figure 3:
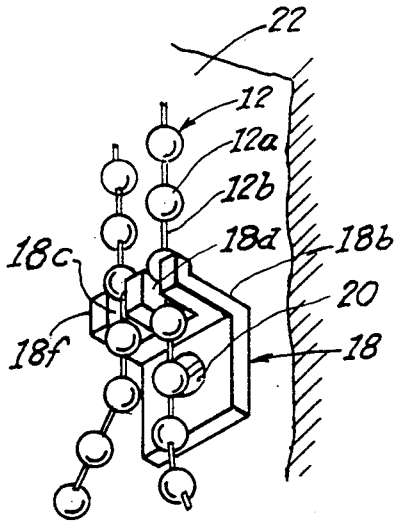
FIG. 3 is a lower perspective view of the present invention in a locked disposition relative to a vertical blind chain actuator.

FIG. 3 shows the vane tilt control lock in accordance with the invention 18 as substantially an L-shaped rigid body having a first portion that receives fastener 20 that is flat and fits snug against wall 22 and a second panel 18B that is rigid and extends out 90° from the wall and first portion of the device. Mounted in slots **18*c* are the two ball chain segments of chain 12 that include chain balls 12*a* connected together by wire segments 12*b*. The fastener is mounted in aperture 18*e* in the center of flat surface 18*a*. Note that the slots or channels 18*c* and 18*d* which extend perpendicular to the wall surface are sized so that the chain balls 12*a* which are adjacent and are locked and engaged in the device as shown in FIG. 3 are such that the diameter of the locked chain balls are larger than the slot width 18*c* and 18*d* insuring that the chain cannot move vertically through the slots. In addition, a raised flange 18*f* projecting above surface 18*b* at the end of the slots 18*c* and 18*d* also insure that the chain will not slide horizontally out of its engagement but in fact acts as a stop near the open ends of the slots. Thus to disengage the chain 12** the lowermost chain ball is manually pulled forward and then upwardly so that the adjacent chain balls will disengage the device.

Figure 4:
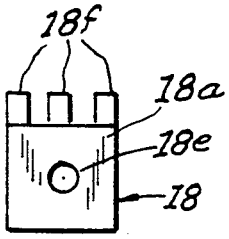
FIG. 4 is a back elevational view of the present invention.
Figure 5:
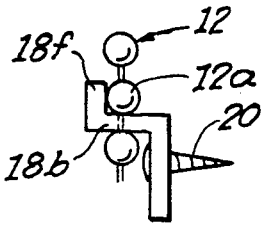
FIG. 5 is a side elevational view of the present invention.

FIG. 4 shows the fastening aperture **18*e* mounted in flat surface 18*a* which attaches against the wall and the flanges 18*f* which act to prevent the chain from sliding off of the mechanism near the ends of the slots. Also FIG. 5 shows the action of the flanges 18*f* which are substantially perpendicular to the panel 18*b* containing the slots. Note the thickness of panel 18*b* in that it allows the adjacent chain balls 12*a* to fit snugly on each side of panel 18*b* being slightly thinner than the length of the wire 12*b* that connects adjacent chain balls. Fastener 20** is shown as a threaded screw.

Figure 6:
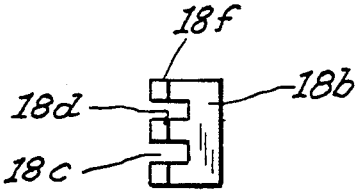
FIG. 6 is a top plan view of the present invention.

FIG. 6 shows that flanges **18*f* at the tip of each of the slots 18*c*, 18*d***.

Although the tilt vane chain lock 18 has been shown in the preferred embodiment as a "L"-shaped solid member having a pair of horizontal slots strategically sized to fit the ball chain based on the chain ball diameter and the distance or length of the wire connecting adjacent chain balls, other configurations are possible provided they assure that both vertical segments of the control chain for the tilt vane mechanism can be simultaneously tautly held to prevent either the pinion gear or pulley connected to the tilt vane mechanism from movement in either direction. It is also essential that the apparatus in accordance with the invention be firmly and rigidly mounted such as on the wall to prevent any movement of the chain to prevent movement of the blinds.

To operate the invention one takes the actuator chain 12 and manually inserts once taut from the control mechanism into each slot of the device 18 once the particular vane tilt position has been selected. Once both segments of chain are inserted and taut, the vertical blind vanes cannot move rotationally.

What I claim is:

1. A vertical blind vane tilt control lock manually locking the position of a vertical blind vane control chain having chain balls connected together by chain links, said chain having two separate vertical hanging segments to rotate vertical blind vanes from an opened to a closed position, comprising:

a rigid body having a first substantially flat segment having two parallel slots, and a second substantially flat segment connected perpendicular to said first flat segment having a wall engaging flat surface, each of said first segment slots being sized to connectably engage through manual actuation a different segment of the vertical blind vane control chain to prevent relative movement between said body and the vertical blind vane control chain;

means engagable with said body wall engaging surfaces for connecting said mounting surface of said body to a vertical wall whereby the body is mountable in a location that provides for manual connectible engagement and manual removal of the two chain vane control segments to and from said body;

said vertical blind vane tilt control chain includes a closed loop chain having chain balls and connecting wires, and wherein each of said body first segments slots include a slot width smaller than the diameter of the chain balls for lockably engaging segments of the chain in said slots, said body first segment thickness being larger than the distance between adjacent chain balls defined by a respective chain link;

said body first segment including engaging lips disposed upwardly at a first end of said body first segment to prevent horizontal movement of the control chain balls through the open ends of said slots.

2. A double chain lock for a vertical blind vane tilt chain actuator formed in a closed loop, said chain actuator having two separate chain segments used to rotatably tilt vertical blind vanes, said chain lock used to prevent rotation and movement of said vertical blind vanes such as might be caused from wind or moving air engaging said vertical blind vanes, said chain having chain balls and connecting wire comprising:

vane chain tilt actuator formed in a closed loop, moveable in first and second opposing directions to move the blind vanes from a first position to a second position, the chain actuator having two separate chain segments used to tilt a plurality of vertical blind vanes, said chain activator used to prevent rotation and movement of the vertical blind vanes such as might be caused from wind or moving air engaging the vertical blind vanes, the chain actuator having chain balls and connecting wire, forming links;

a first flat panel having a aperture sized to receive a threaded fastener;

second flat panel connected orthogonally to said first flat panel, said second flat panel having three rigid straight equally sized flanges forming first and second chain locking slots for engaging and locking in said first and second chain locking slots, said vertical blind actuator chain;

a wall threaded fastener sized to be received through said first flat panel aperture, said first flat panel being mountable rigidly on a wall surface sufficiently close to said vertical blind chain actuator segments such that said chain actuator segments can be manually engaged and locked and manually removed from said first and second slots in said second panel, each flange having a raised upwardly extending vertical lip having a front to back thickness less than the distance between two chain balls.

3. A vertical blind vane tilt control lock for manually locking the position of vertical blind vanes, said vertical blinds having a vertical blind vane control chain hanging vertically down from said vertical blind vane control mechanism, said chain having at least two vertical separate segments, each segment controlling a different direction of movement of said vertical blind vanes, said vertical blind vane tilt control lock engagable with said control chain segments and comprising:

a vertical blind vane control chain hanging vertically down from a vertical blind vane control mechanism, the chain having at least two vertical separate segments, each segment controlling a different direction of movement of the vertical blind vanes, a rigid flat back plate having an aperture substantially in its central portion for receiving a wall fastener, said rigid back plate being relatively small and thin to unobtrusively be mounted to a vertical wall surface;

a threaded fastener mountable through said aperture for mounting said ragid back plate to a flat vertical wall surface;

three rigid flanges spaced apart in parallel equally to form two parallel slots, said three rigid flanges being substantially straight and perpendicular to said back plate, said back plate having an upper and lower edge portion, said three rigid flanges being perpendicular to the upper portion edges of said back plate extending outwardly and orthogonally to said back plate, said three flanges forming two spaces, said spaces being smaller between adjacent flanges laterally than the diameter of the chain balls, said flanges being sized in thickness vertically to be smaller than the chain link between two adjacent chain balls, each of said three rigid flanges having disposed at their free end an upward projecting lip perpendicular to each of said flanges and spaced apart equal to the slot size separation distance, said lips being sized from front and back that is toward and away from said rigid back plate a thickness less than the chain link distance between adjacent chain balls, said means for manually locking providing a double chain segment lock formed by said adjacent slots for coordinated manual engagement and disengagement of the control chain segments together to create tension in both of the chain segments between the vertical blind vane control mechanism and said means for manually locking, thereby preventing vane movement in either direction.

* * * * *